United States Patent [19]

Preiser et al.

[11] 4,046,094

[45] Sept. 6, 1977

[54] ANTIFOULING SYSTEM FOR ACTIVE SHIPS AT REST

[76] Inventors: Herman S. Preiser, 2 Revell Road, Severna Park, Md. 21146; Arthur Ticker, 12117 Maddox Lane, Bowie, Md. 20715

[21] Appl. No.: 682,889

[22] Filed: May 3, 1976

[51] Int. Cl.[2] ..... B63B 29/00
[52] U.S. Cl. ..... 114/222
[58] Field of Search ..... 114/222, .5 R, 270; 47/9; 9/1.7; 61/54

[56] References Cited

U.S. PATENT DOCUMENTS

| | | | |
|---|---|---|---|
| 2,138,831 | 12/1938 | Brammer | 114/222 |
| 3,142,283 | 7/1964 | Fisher | 114/222 |
| 3,241,512 | 3/1966 | Green | 114/222 |
| 3,837,916 | 9/1974 | Omachi | 114/222 |

OTHER PUBLICATIONS

Runkel, S. T., "Black Plastic Sheets Control Pondweeds," Successful Farming, Sept., 1964, p. 98.

*Primary Examiner*—Trygve M. Blix
*Assistant Examiner*—Jesus D. Sotelo
*Attorney, Agent, or Firm*—R. S. Sciascia; Q. E. Hodges

[57] ABSTRACT

A system for discouraging and inhibiting growth of the entire marine fouling community onto a ship hull while it is at rest in brackish or seawater. A pipe or pipes having nozzles distributed therealong, run the length of the keel. Fresh water is supplied to the pipe which flows out the nozzles and up along the hull to create and maintain a moving boundary layer of fresh water. Such movement also serves to inhibit fouling. An enclosure comprising segmented, over-lapping, opaque curtains hang down by weights, from the ship-deck. These curtains serve to prevent light from reaching the hull, and to protect the thin boundary layer of fresh water from the disruptive, mixing actions caused by the surrounding currents. Thus the marine fouling community, including tubeworms, barnacles, grass, and algae, may be inhibited from growing and adhering to the hull surface.

7 Claims, 2 Drawing Figures

ANTIFOULING SYSTEM FOR ACTIVE SHIPS AT REST

The invention described herein may be manufactured and used by or for the Government of the United States of America for governmental purposes without the payment of any royalties thereon or therefor.

BACKGROUND OF THE INVENTION

The prior art systems and methods of antifouling address themselves either to defouling an already fouled hull bottom, or to attacking only a portion of the marine fouling community. Apparently it was thought that some marine organisms are detachable from a ship hull because they are killed by fresh water, but it is known that some, in particular barnacles, have such a tenacious cement or adhesive action, that they are impossible to detach even though they can be killed. Also some algae, and grasses will grow in fresh water but not in the absence of light as is well known. The prior art appears to ignore the exclusion of light as a means to inhibit marine growth.

The use of antifouling coatings on ship bottoms is well known. These toxic coatings leach out a poison to kill growths before they form, but have a limited life of perhaps 1 to 2 years. Recently, the service life of these coatings has been extended to perhaps 5 years by using exotic and highly toxic materials, but both fouling and coatings must be mechanically removed and the hull then repainted by taking the ship out of service in a dry dock. In addition, toxic materials leached into the waters, or spread on the shore as dust during the abrasize blasting for removing the antifouling paints, contribute significantly to the pollution of the environment. Also any fouling of a ship bottom by the marine fouling community decreases the ship's speed capability and increases the fuel used for propulsion because of the rough bottom that is formed.

SUMMARY OF THE INVENTION

Briefly, the instant invention overcomes the disadvantages of the prior art antifouling or defouling systems by providing a system for discouraging and inhibiting the growth of the entire marine fouling community onto a ship hull. A pipe or pipes are secured along the length of the keel and have perforations or nozzles distributed therealong. Fresh water supplied from the ship's internal fresh water piping system or a dockside system is pumped out of the nozzles to create and maintain a boundary layer of fresh water flowing along and up the hull to the surface. An enclosure is formed around the sides of the ship, comprising segmented, overlapping, opaque curtains weighted at the bottom to hang down from, perhaps, the ship deck or other support above the waterline. The fresh water layer inhibits growth of some of the marine fouling community, and the flow rate helps to inhibit adherence to the hull. Since it is known that fouling does not occur on ships at speeds above approximately three knots, no fouling will attach after the system is secured and after the ship is underway. The opaque curtains serve to prevent light from reaching the hull to inhibit the growth of still other portions of the marine fouling community such as for example, algae and grasses, and to protect the fresh water boundary layer from disruptive currents.

STATEMENTS OF THE OBJECTS OF THE INVENTION

Accordingly, an objective of the present invention is to provide a new, improved, simple, efficient and reliable system for discouraging and inhibiting growth of the entire marine fouling community on a ship hull.

Another objective of the instant invention is to provide a non-polluting and non-disturbing system for inhibiting the growth of the marine fouling community.

Still another objective of the present invention is to provide a system of inhibiting growth of the marine fouling community that is compatible with existing antifouling paint systems and increases the efficiency and extends the service life of these systems.

A still further objective of the instant invention is to provide a system of inhibiting growth of the marine fouling community to extend periods between ship drydockings.

Still another objective of the present invention is to provide a system of inhibiting growth of the marine fouling community to increase ship speed capability and to decrease propulsion fuel consumption while the ship is underway.

A still further objective of the instant invention is to provide a system of inhibiting growth of the marine fouling community on a ship hull at any time while it is at rest without taking it out of service.

BRIEF DESCRIPTION OF THE DRAWINGS

A more complete understanding of the invention and many of the attendant advantages thereto will be apparent from the following detailed description when considered in conjunction with the accompanying drawings, wherein.

DESCRIPTION OF THE PREFERRED EMBODIMENT

Figure 1:
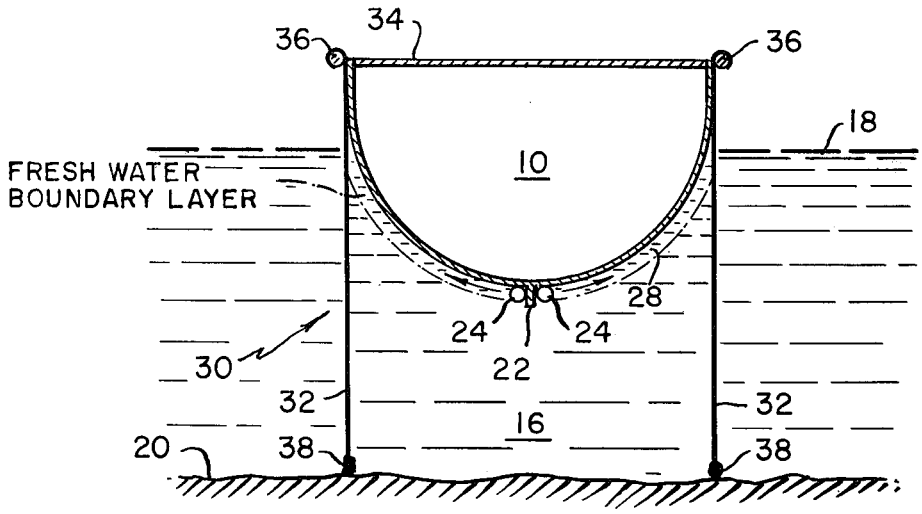
FIG. 1 is a transverse cross-section of a ship hull with the marine growth inhibiting system shown in schematic form.
Figure 2:
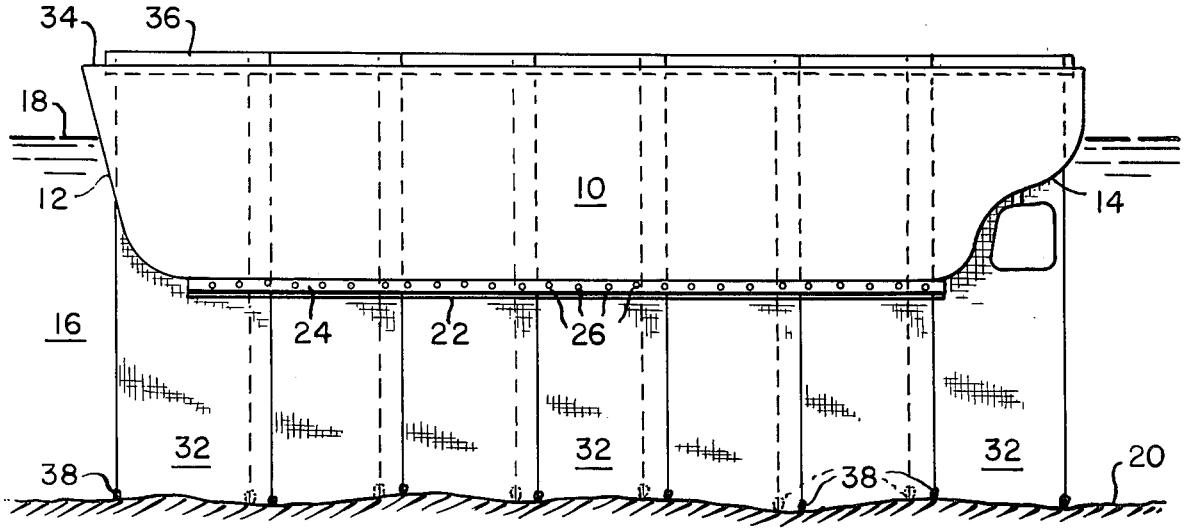
FIG. 2 is an side elevation of a ship hull with the marine growth inhibiting system installed.

Referring now to the drawings wherein like numerals refer to the same element, there is shown in FIG. 1 and FIG. 2 generally, a ship hull 10, having a bow 12 and a stern 14. The ship hull 10 is floating in a body of water 16, having a surface 18 and a bottom 20.

The ship hull is shown having a protruding keel 22 extending from the bow 12 to the stern 14, but it is understood in the art that the keel 22 need not protrude. Therefore, two pipes 24, one on each side of the keel are shown, particularly in FIG. 1, and having a plurality of perforations or nozzles 26 positioned at equal intervals therealong. If there were no protruding keel 22, only one pipe 24 would be needed having perforations or nozzles 26 on both sides of it. These pipes 24 are connected to the ship's internal fresh water system or dockside system (not shown) to supply the pipes with a flow of fresh water when desired. This fresh water flows out the perforations or nozzles 26 and thence up and along the ship hull 10, forming a thin boundary layer 28 thus causing a significant reduction in salinity near the hull surface. The fresh water flow follows up and along the hull surface to the surface of the body of water 18 by virtue of its lesser density of 62.5 No./cu. ft. compared to the usual seawater density of 64 No./cu. ft. The flow rate along the hull surface of the boundary layer 28 is maintained by continuous feed, and due to the density difference.

Chemical additives, such as chlorine or hypochlorites may be added to the fresh water boundary layer for increased toxicity if necessary. In addition the boundary layer flow system could be automated by the use of salinity, pH, chlorine, or other sensors (not shown) built into the hull, that could control the system, as required, to maintain the desire condition of a clean unfouled hull.

A light-excluding enclosure 30 is formed around the ship hull 10 and comprises curtain segments 32 made of a flexible opaque material, such as black, reinforced polyethylene, polyvinyl chloride, or other suitable plastic or elastomeric sheeting. The curtain segments 32 hang from the hull from above the waterline, perhaps from the ship deck 34. For convenience of deployment and retrieval and to better conform to a ship hull, the curtain segments 32 may be approximately 6 feet wide and may be wound on rods or rollers 36, made of wood, metal, plastic, much like shade rollers that are operated manually or mechanically (not shown). The curtain segments 32 have weights 38 attached at their bottom to sink to the bottom 20 of body of water 18, or dangle freely sufficiently below the keel line to completely prevent light from entering the enclosure. The curtain segments 32 overlap one another to exclude all light from the hull 10, but permit some movement and displacement of the seawater back and forth. However, the curtains 32 do protect the thin fresh water boundary layer 28 from disruptive currents of the seawater.

The system is put into operation at any time the ship comes to rest, say alongside a dock or at anchor, because this is when fouling occurs. The fresh water boundary layer flow means and curtain enclosure must be used in combination thereby discouraging and inhibiting the growth of the entire marine fouling community. The fresh water boundary layer on the hull surface addresses the growth problem of the portion of the marine fouling community of barnacles, tubeworms, and other organisms and the like. Fresh water inhibits their growth, by interfering with their melabolic processes. The curtain enclosure, excluding all light addresses the growth problem of the other portion of the marine fouling community such as grasses, and algae. Thus this system addresses itself to the entire marine fouling community, to maintain a clean hull bottom for speed and economy, augments the usual antifouling paint systems, and extends the ship's in-service time by reducing drydockings for hull cleaning.

Obviously, many modifications and variations of the present invention are possible in light of the above teachings. It is therefore to be understood that within the scope of the appended claims, the invention may be practiced otherwise than as specifically described.

What is claimed is:

1. A system for discouraging and inhibiting the growth of the entire marine fouling community onto a ship's underwater hull surface comprising:

means for providing a thin boundary layer of water along the underwater hull surface of low enough salinity to inhibit a portion of the marine fouling community; and means for excluding all light from underwater hull surface to inhibit another portion of the marine fouling community to thereby inhibit the growth of the entire fouling community.

2. The system of claim 1 wherein said means for providing a thin boundary layer includes:

means providing a continuous feed of fresh water to maintain the boundary layer at reduced salinity to inhibit the adherence and growth of the marine fouling community on the ship's hull.

3. The system of claim 2 wherein said means for providing a thin boundary layer of water comprises:

at least one pipe attached along the ship keel from the bow to the stern of the ship;

a plurality of perforations, forming nozzles, along said pipe; and a supply of fresh water to said pipe causing a flow from each of said perforations.

4. The system of claim 3 wherein said means for excluding all light from the underwater hull surface further comprises:

a light-excluding curtain draped around the ship hull and extending from the deck to below the keel in the body of water in which the ship floats.

5. A system for discouraging and inhibiting the growth of the entire marine fouling community onto a ship's underwater hull surface comprising:

means providing a thin boundary layer of water of reduced salinity along the underwater hull surface, said salinity being low enough to inhibit the growth of a portion of the marine fouling community;

means comprising a light excluding curtain enclosure draped around the ship hull and extending from the deck to below the ship keel, said curtain being composed of a plurality of overlapping curtain segments with weights attached to the bottom of each segment to thereby exclude light and inhibit the growth of another portion of the fouling community.

6. The system of claim 5 wherein said curtain enclosure further comprises:

a roller attached at the top of each of said curtain segment and on the deck to facilitate deployment and retrieval of said curtain enclosure.

7. The system of claim 6 wherein said means for providing a thin boundary layer of water further includes:

an addition of chlorine gas and other toxic additives to said boundary layer.

* * * * *